United States Patent [19]

Joyner

[11] 4,358,260

[45] Nov. 9, 1982

[54] ROTARY INTERMESHING GEAR MACHINE WITH PRESSURE-BALANCING INCLUDING RESILIENT AND NON-EXTRUDABLE SEALING MEMBERS

[75] Inventor: Philip G. Joyner, Brockworth, England

[73] Assignee: Dowty Hydraulic Units Limited, Cheltenham, England

[21] Appl. No.: 158,154

[22] Filed: Jun. 10, 1980

[30] Foreign Application Priority Data

Jun. 16, 1979 [GB] United Kingdom ..... 7921041

[51] Int. Cl.[3] ..... F01C 1/18; F01C 19/08; F03C 2/08; F04C 2/18

[52] U.S. Cl. ..... 418/132

[58] Field of Search ..... 418/131-133

[56] References Cited

U.S. PATENT DOCUMENTS

| | | | |
|---|---|---|---|
| 3,142,260 | 7/1964 | Oliver | 418/132 |
| 3,371,615 | 3/1968 | Pettyjohn et al. | 418/132 |
| 3,482,524 | 12/1969 | Marietta | 418/132 |
| 3,539,282 | 11/1970 | Forschner | 418/132 |
| 3,891,360 | 6/1975 | Dworak et al. | 418/132 |
| 4,242,066 | 12/1980 | Hodgson | 418/132 |

*Primary Examiner*—John J. Vrablik

*Attorney, Agent, or Firm*—Young & Thompson

[57] ABSTRACT

A rotary positive-displacement fluid-pressure machine which includes a casing, two intermeshing rotors, end plate means associated therewith, and a pressure-balancing arrangement associated with the end face of each end plate means remote from the rotors and with an adjacent casing face. The arrangement comprises sealing means which separate, one from another, a plurality of areas on said end face individually subjectable to fluid-pressures and which comprise resilient members disposed in respective grooves, as well as a non-extrudable element against portions of which those members bear. The members and element together establish fluid-sealing between the end face remote from the rotors and the adjacent casing face. At least one portion of said non-extrudable element is so disposed as to cross a respective land which is recessed to accommodate that portion.

16 Claims, 11 Drawing Figures

Figure 1:
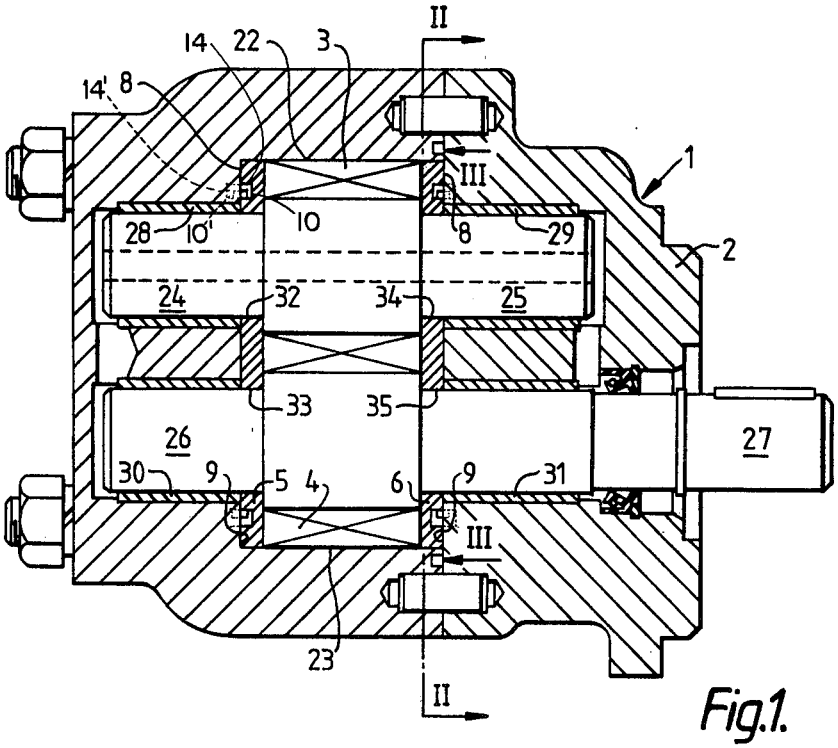

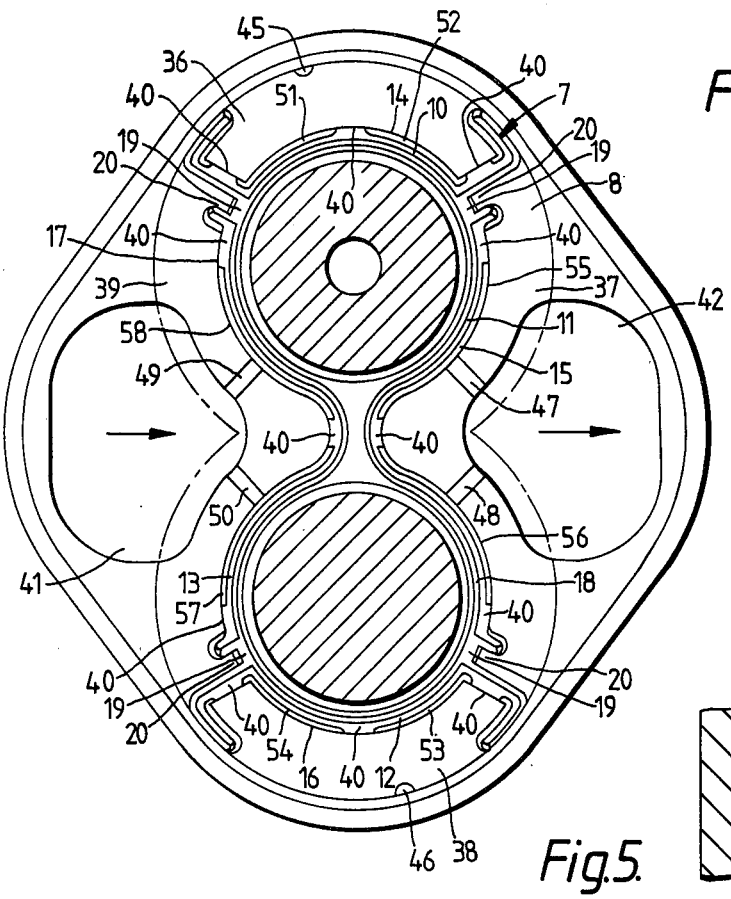
Fig.3.
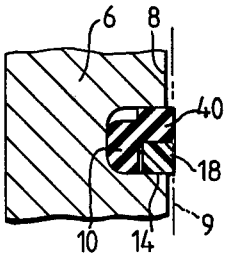
Fig.5.
Fig.4.
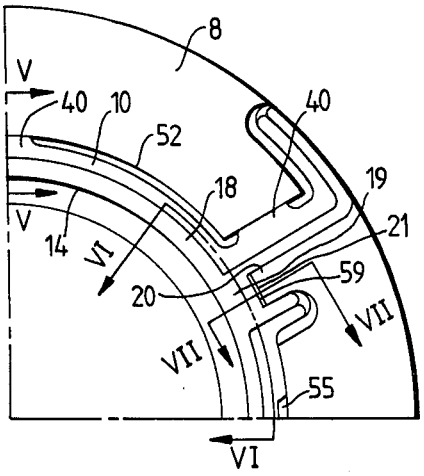
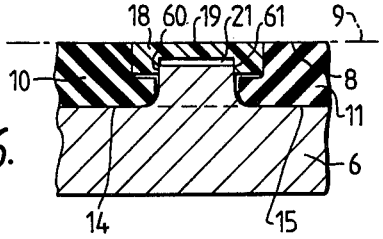
Fig.6.
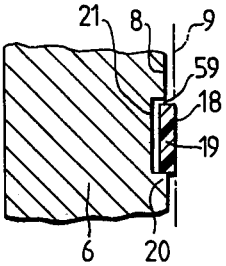
Fig.7.

ROTARY INTERMESHING GEAR MACHINE WITH PRESSURE-BALANCING INCLUDING RESILIENT AND NON-EXTRUDABLE SEALING MEMBERS

This invention relates to a rotary intermeshing gear machine with pressure-balancing including resilient and non-extrudable sealing members, for example a gear pump or a gear motor.

Hitherto certain such machines have included an arrangement whereby end plate means provided in association with the rotors of the machines are pressure-balanced. Such pressure-balancing has been intended to avoid inadvertent tilting of the end plate means and the onset of consequent premature wear of the rotors and/or end plate means otherwise experienced in machines not so provided with pressure-balancing.

In order to achieve such pressure-balancing of the end plate means, those faces of the end plate means remote from the rotors have been so divided by sealing means as to define areas of the faces which are subjectable to low fluid-pressures and areas of the faces which are subjectable to high fluid-pressures, the relative sizes of these areas and their disposition being so predetermined that the pressures acting thereupon in operation of the machine do so in opposition to the pressures which subsist in the working spaces of the machine and which are effective upon those faces of the end plate means adjacent the rotors. The pressure-balancing arrangement is intended also to urge the end plate means into adequate sealing engagement with the rotors without the generation of undue friction between the end plate means and the rotors.

The sealing means so defining said areas have been in the form of resilient members, for example, members of elastomeric material, housed in suitable grooves. However, due to high pressure differentials to which these members have been subjected in the direction across the faces of the end plate means remote from the rotors, it has been found necessary to provide non-extrudable elements in association with the members to protect them against damage and to avoid consequential undesirable leakage of fluid from a respective high-pressure face area to a respective low-pressure face area. Hitherto such elements have been difficult to locate and to maintain in their correct relation with respect to their associated resilient members, particularly where the low-pressure and high-pressure areas have been such that a number of said elements, each of somewhat complex shape, have been provided in association with respective resilient members of like shape. Further, where a number of said elements are provided it has been often difficult to ensure that they are sufficiently well-placed as to provide a complete protection against the flow of certain small portions of the material of the resilient members under the subsisting pressure-differentials acting thereupon.

The invention as claimed is intended to provide a remedy. It solves the problem of how to design a rotary positive-displacement machine, having a pressure-balancing arrangement, in which the resilient members have associated non-extrudable elements which can be located with ease, and reliably held, in their required positions in relation to said resilient members, thereby averting any danger of leakage of fluid from high-pressure areas to low-pressure areas of the machine in the regions of the end plate means.

According to this invention a rotary positive-displacement fluid-pressure machine includes a casing, at least two intermeshing rotors housed for rotation in said casing, end plate means associated with said rotors, and a pressure-balancing arrangement associated with the end face of the or each end plate means remote from said rotors and with an adjacent face of said casing, said pressure-balancing arrangement comprising sealing means which separate, one from another, a plurality of areas on said end face individually subjectable to fluid-pressures and which comprise a plurality of resilient members disposed in respective grooves, spaced one from another, and a non-extrudable element against portions of which said resilient members bear, said members and said element together establishing fluid-sealing between said end face and said adjacent face, and at least one portion of said element being so disposed as to cross a respective land which is recessed to accommodate said portion and which spaces two adjacent said grooves apart.

The advantages offered by the invention are mainly that the or each said non-extrudable element associated with a plurality of resilient members is formed in one piece, which facilitates assembly of the sealing means into the machine, and is provided with at least one portion which bridges from one said groove to an adjacent said groove and yet which contributes to the sealing between the respective said end face and the respective said adjacent face. Further, the or each said portion affords sealing, in the direction across the respective said end face, between high fluid-pressure regions and low fluid-pressure regions of the machine.

Figure 2:
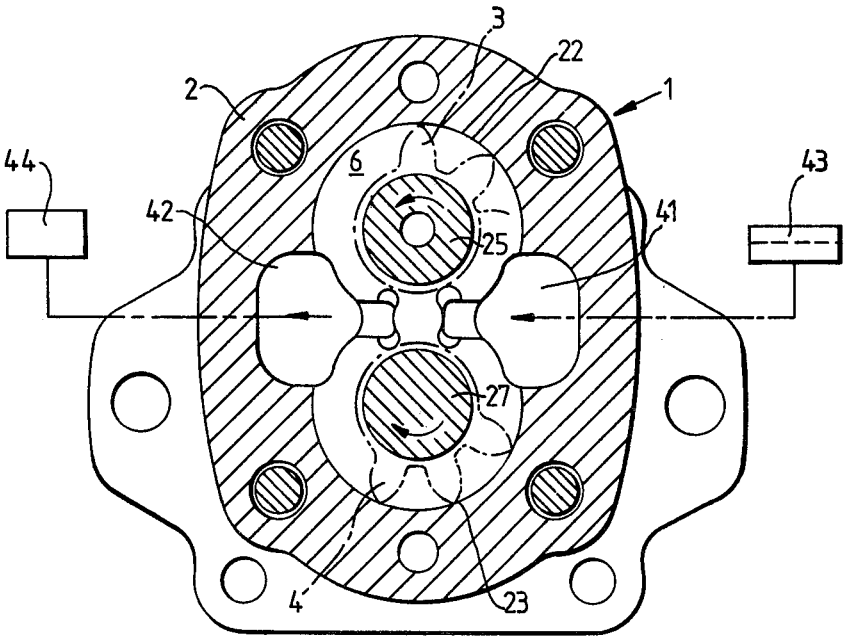
Figure 8:
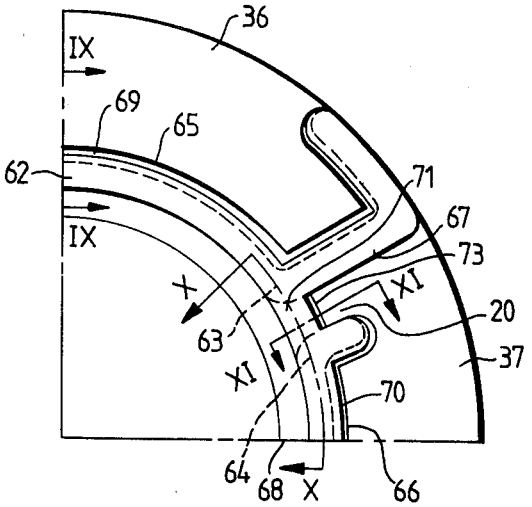
Figure 9:
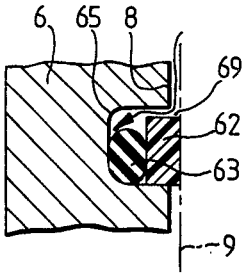

Two ways of carrying out the invention are described in detail below with reference to drawings which illustrate two specific embodiments, in which:

FIG. 1 is a cross-section of a rotary positive-displacement machine, in the form of a gear pump, in accordance with the first embodiment, FIG. 2 is a cross-section taken along the line II—II on FIG. 1, FIG. 3 is an enlarged partial cross-section taken along the line III—III on FIG. 1, FIG. 4 is an enlarged view of a part of the cross-section shown in FIG. 3, FIG. 5 is an enlarged cross-section taken along the line V—V on FIG. 4, FIG. 6 is an enlarged cross-section taken along the line VI—VI on FIG. 4, FIG. 7 is an enlarged cross-section taken along the line VII—VII on FIG. 4, FIG. 8 is an enlarged view similar to that of FIG. 4 but in accordance with the second embodiment, FIG. 9 is an enlarged cross-section taken along the line IX—IX on FIG. 8.

Figure 10:
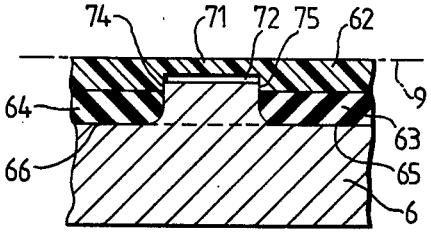
Figure 11:
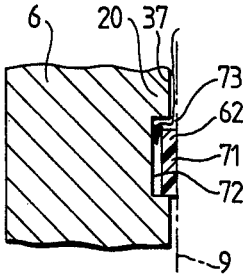

FIG. 10 is an enlarged cross-section taken along the line X—X on FIG. 8, and, FIG. 11 is an enlarged cross-section taken along the line XI—XI on FIG. 8.

The figures show a rotary positive-displacement fluid-pressure machine 1 in the form of a gear pump intended to draw liquid from a source and to deliver this liquid under pressure to a point of usage. In its basic design the machine includes a casing 2, at least two intermeshing rotors 3, 4 housed for rotation in the casing, end plate means 5, 6 associated with the rotors, and a pressure-balancing arrangement, generally indicated at 7, associated with the end face 8 of the or each end plate means remote from the rotors and with an adjacent face 9 of the casing, the pressure-balancing arrangement comprising sealing means which separate, one from another, a plurality of areas on the end face individually subjectable to fluid-pressures.

In accordance with the invention the sealing means comprise a plurality of resilient members 10, 11, 12, 13 disposed in respective grooves 14, 15, 16, 17, spaced one from another, and a non-extrudable element 18 against portions of which said resilient members bear, the members and the element together establishing fluid sealing between the end face 8 and the adjacent face 9, and at least one portion 19 of the element being so disposed as to cross a respective land 20 which is recessed at 21 to accommodate the portion 19 and which spaces two adjacent said grooves apart.

As shown, the grooves 14, 15, 16, 17 and thus the recessed lands 20 are formed in the end face 8 of a respective end plate means 5, 6.

The rotors 3, 4 comprise gears housed in overlapping bores 22, 23 formed in the casing 2, these gears having shafts 24, 25, 26, 27 extending from both sides thereof. The shaft 27, by which the pump is driven, projects to the exterior of the casing 2 and all the shafts are rotatably mounted in respective bushes 28, 29, 30, 31 provided in the casing.

The end plate means 5, 6 provided on each side of the two intermeshing gears 3, 4 are each suitably apertured at 32, 33; 34, 35, respectively to receive the shafts 24, 26, 25, 27, and are each generally of figure-of-eight shape.

In this embodiment the resilient members 10, 11, 12, 13 are of elastomeric material and each of the non-extrudable elements 18 is of plastics material. The resilient members and adjacent portions of the respective non-extrudable elements are suitably maintained in the respective grooves 14, 15, 16, 17 in substantially parallel manner.

As shown in FIGS. 3 and 4 the said adjacent portions are disposed on those sides of their respective resilient members remote from the associated one of the areas 36, 37, 38, 39 on the end face 8 individually subjectable to fluid pressures.

Spacing means 40 are provided on that side of each resilient member 10, 11, 12, 13 adjacent its associated area 36, 37, 38, 39, these means being of elastomeric material, formed integrally with their respective resilient members, and suitably spaced apart therealong as shown in FIG. 3.

Each non-extrudable element 18 is formed in one piece and is so shaped that all of its associated resilient members 10, 11, 12, 13 are in substantially full lengthwise engagement with respective portions of that element.

The gear pump is operable in either direction of rotation of the shaft 27 in dependence upon which of the two ports 41 and 42, formed in the casing 2, is connected to a source of liquid and which of them is connected to a point of usage. As shown in FIG. 2 of the drawings the port 41 is connected to the source, that is a reservoir 43, being thus the inlet or low-pressure port, and the port 42 is connected to the point of usage, that is a device 44 to be operated by the gear pump, being thus the outlet or high-pressure port. Hence as viewed in FIG. 2 the gear 4, which is the driver gear, is rotatable in the clockwise direction while the gear 3, which is the driven or idler gear, is rotatable in the anti-clockwise direction.

The four areas 36, 37, 38 and 39 formed on each of the two end plate means 5, 6 and separated by the sealing means are individually subjectable to fluid-pressures. To this end the areas 36 and 38 are respectively in communication, by way of grooves 45 and 46 suitably positioned in the outer surface of the respective end plate means, with intertooth zones in the working spaces of the pump which are at high fluid-pressure, and the area 37 is in direct communication with the outlet port 42 and thus, like the areas 36 and 38, is subjectable to high fluid-pressure. The area 39 is in direct communication with the inlet port 41 and thus unlike the areas 36, 37 and 38 is subjectable to low fluid-pressure. Hence, a far larger area of the end face 8 of each end plate means is subjectable to high-pressure than to low pressure, and this during pump operation so loads the face 8 as to balance out those forces upon the face of the end plate means adjacent the gears 3, 4 which arise as liquid drawn in at the port 41 is being raised in pressure by rotation of the gears and which would otherwise produce tilting of the end plate means. At the same time each end plate means is urged into adequate sealing engagement with the respective side faces of the gears without the generation of undue friction between them.

Since in this embodiment there are four grooves 14, 15, 16, 17 in each end plate means, four lands 20 are provided on each end face 8. Each of the two non-extrudable elements 18 includes four of the portions 19 which are so disposed as each to cross a respective land 20, and each to be accommodated in a respective recess 21.

Radially-disposed grooves 47, 48, 49, 50 are provided in the end face 8 of each end plate means 5, 6. The grooves 49, 50 connect the inlet port 41 to the groove 17 at the two positions shown, while the grooves 47, 48 connect the outlet port 42 to the groove 15 at the two positions shown.

In operation of the gear pump above described, the intermeshing gears 3, 4 draw liquid from the reservoir 43 into the inlet port 41 and discharge this liquid under high-pressure by way of the outlet port 42 to the device 44.

Liquid under high-pressure from gear intertooth spaces gains access by way of the grooves 45, 46 to the areas 36, 38 on each of the end plate means 5, 6, thereby pressurising those areas axially of the pump. This liquid also passes into arcuate clearances 51, 52, 53, 54 established by the spacing means 40 and formed between the high-pressure sides of the resilient members 10, 12 and the adjacent sides of the respective grooves 14, 16. The liquid thus pressurises the resilient members 10, 12 into sealing engagement with the faces 9. These members in turn bear against the adjacent portions of the respective non-extrudable element 18 to urge those portions into sealing engagement with the other sides of the respective grooves and also into sealing engagement with the face 9 in such manner as to resist extrusion of the material of the members 10, 12 under the high liquid-pressure acting thereupon.

At the same time liquid under high-pressure from the outlet port 42 which acts upon the area 37 of each end plate means 5, 6 gains access by way of the grooves 47, 48, to arcuate clearances 55, 56 established by the spacing means 40 and formed between the high pressure side of the resilient member 11 and the adjacent side of the groove 15. The liquid thus pressurises the resilient member 11 into sealing engagement with the face 9. This member in turn bears against the adjacent portion of the non-extrudable element 18 to urge it into sealing engagement with the other side of the groove 15 and also into sealing engagement with the face 9 to resist extrusion of the material of the member 11.

Also at the same time, liquid at low-pressure in the inlet port 41 which acts upon the area 39 of each end plate means 5, 6 gains access by way of the grooves 50, 49 to arcuate clearances 57, 58 established by the spacing means 40 and formed between the sides of the resilient member 13 and the sides of the groove 17 both adjacent the inlet port. Here, the portion of the element 18 associated with the member 13 is urged against the face 9 by the inherent resilience of that member.

The edges of the portions of each non-extrudable element 18 remote from the adjacent resilient members 10, 11, 12, 13 and adjacent the respective shafts 24, 25, 26, 27 are subjected to low fluid-pressure.

The pressure-loading upon those portions of each element 18 engaged by the respective resilient members associated with the areas 36, 37, 38 is such that a side of each of those portions is held in positive sealing engagement with the adjacent side of the respective groove, as at 14, as shown in FIG. 5. However, of those four portions 19 of the element 18 having no resilient member in engagement therewith, the portion 19 received by the recess 21 disposed between the areas 36 and 37 and the portion 19 received by the recess 21 disposed between the areas 37 and 38 are subjected to a high pressure differential in the radial direction because the area 37 is directly subjected to pump delivery pressure, while the edge of each portion 19 radially-inwardly remote from that area is subjected to the low-pressure subsisting in the regions of the shafts.

Hence, each of these two portions 19 are, in the manner shown in FIG. 7, urged, by fluid under high-pressure from the area 37 which gains access to the underside of the portion by way of the clearance 59, not only into positive sealing engagement with the face 9 but into positive sealing engagement with one of the two sides of the respective recess 21. Thus these two portions resist leakage of high-pressure liquid from the area 37 into the low-pressure regions of the shafts.

Further, as shown in FIG. 6, each of the four portions 19 of the element 18 is stepped down to a reduced thickness at its respective recess 21, faces thereby formed being indicated at 60 and 61. These faces overlap, and are engageable with, the adjacent sides of the respective grooves, as at 14, 15, at the base of the respective recess. Since the areas 36 and 37 are both subjected to high-pressure there is negligible pressure differential, if any, across that portion 19 therebetween and in the direction circumferentially of the face 8. Similarly, since the area 38 is also subjected to high pressure, there is negligible pressure differential, if any, across that portion 19 between the areas 37 and 38 and in the direction circumferentially of the face 8. However, since the area 38 is subjected to high-pressure and the area 39 is subjected to low-pressure, that portion 19 between them is subjected to a high pressure differential in one direction circumferentially of the face 8. Similarly, since the area 36 is subjected to high-pressure and the area 39 is subjected to low-pressure, that portion 19 between them is also subjected to a high pressure differential but in the other direction circumferentially of the face 8. Hence a face, such as at 60, 61 in FIG. 6, of each of those two portions 19 so subjected to a high pressure differential is urged into positive sealing engagement with the appropriate side of the respective groove at the base of the respective recess 21, thus to prevent the leakage of high-pressure liquid from the area 36 and from the area 38, across the respective recesses into the groove 17 and thus the low-pressure area 39.

With reference now to FIGS. 8 to 11, the gear pump construction of the second embodiment is basically similar to that of the first embodiment described above with reference to FIGS. 1 to 7 and includes the four areas 36, 37, 38 and 39 as shown in FIG. 3. However, instead of each set of four resilient members and each non-extrudable element engaging the respective face 9, only each non-extrudable element 62 engages the respective face 9. The four resilient members, two of which are partly shown at 63 and 64, associated with each element 62 are of circular cross-section in their free state and are disposed in respective grooves, as at 65, 66, being thus positioned beneath respective associated portions, as at 67, 68, of the respective element 62. No spacing means, such as at 40 in the first embodiment, are provided.

The associated portions, as at 67, 68 of the elements 62 are somewhat less in width than their respective grooves, thus forming arcuate clearances such as shown at 69, 70. The high fluid-pressure in operation acting on the areas 36, 37 and 38 gains access to three of the four resilient members by way of these clearances, thereby pressurising those three members, which in turn urges the three associated portions of each of the elements 62 into positive sealing engagement with the respective adjacent face 9. This fluid-pressure also urges the three associated portions into positive sealing engagement with that side of the respective groove remote from the respective area 36, 37, 38 as shown in FIG. 9. A fourth associated portion of each element is urged into contact with the respective face 9 by the inherent resilience of the fourth resilient member.

As with the construction of FIGS. 1 to 7, of the four portions of each element 62, one of which is shown at 71, having no resilient member in engagement therewith, that portion received by the recess 72 disposed between the areas 36 and 37 and that portion received by the recess, not shown, between the areas 37 and 38 are each subjected to a high pressure differential in the radial direction because the area 37 is directly subjected to pump delivery pressure, while the edge of each portion 71 radially-inwardly remote from that area is subjected to the low-pressure subsisting in the regions of the shafts. Hence, each of those two portions 71 are, in the manner shown in FIG. 11, urged, by fluid under high-pressure from the area 37 which gains access to the underside of the portion by way of the clearance 73, not only into positive sealing engagement with the face 9, but into positive sealing engagement with one of the two sides of the respective recess 72. Thus these two portions resist leakage of high-pressure liquid from the area 37 into the low-pressure regions of the shafts.

Further, as shown in FIG. 10, each of the four portions 71 of the element 62 is stepped down to a reduced thickness at its respective recess 72, faces thereby formed being indicated at 74 and 75. These faces overlap, and are engageable with, the adjacent sides of the respective grooves, as at 65, 66, at the base of the respective recess. Since the areas 36 and 37 are both subjected to high-pressure there is negligible pressure differential, if any, across that portion 71 therebetween and in the direction circumferentially of the face 8. Similarly, since the area 38 is also subjected to high pressure, there is negligible pressure differential, if any, across that portion 71 between the areas 37 and 38 and in the direction circumferentially of the face 8. However, since the area 38 is subjected to high-pressure and the area 39 is subjected to low-pressure, that portion 71 between them is subjected to a high pressure differential in one direction circumferentially of the face 8. Similarly, since the area 36 is subjected to high-pressure and the area 39 is subjected to low-pressure, that portion 71 between them is also subjected to a high pressure differential but in the other direction circumferentially of the face 8. Hence a face, such as at 74, 75 in FIG. 10, of each of those two portions 71 so subjected to a high pressure differential, is urged into positive sealing engagement with the appropriate side of the respective groove at the base of the respective recess 72, thus to prevent the leakage of high-pressure liquid from the area 36 and from the area 38, across the respective recesses into the low-pressure area 39.

In both of the embodiments above described with reference to the drawings the non-extrudable elements resist such extrusion of their respective resilient members as might otherwise occur when those members are subjected to high fluid-pressure differentials.

Both constructions are such that finite lengths of elastomeric material forming the resilient members can be used, each set of such lengths having a single non-extrudable element associated therewith, resulting in sealing means which can be assembled readily and reliably. Also, since the portions 19 and 71 of the respective non-extrudable element have no elastomeric material associated therewith, the plastics material those portions solely affords fluid-sealing at the inter-groove lands in axial, radial and circumferential directions, thereby avoiding the problem of extrusion of elastomeric material at these positions under high fluid-pressure differentials experienced.

In both of the embodiments above described the pump may be operable in the opposite sense, that is the shaft 27 is rotated in the opposite direction. In this case the inlet port 51 is made the outlet port and the outlet port 42 is made the inlet port.

Further, instead of the machine being operable as a pump it may be operable as a motor in which case either the port 41, or alternatively the port 42, is the high-pressure, inlet, port, while either the port 42, or alternatively the port 41, is the low-pressure, outlet, port, in dependence upon the required direction of rotation of the shaft 27. In this case where there is an appreciable back pressure provided in an exhaust line connected to whichever is the outlet port, a substantial pressure differential may be caused to subsist across those two of the portions 19 or 71 of the respective non-extrudable element closest to the low-pressure port. In this case those portions are caused to seal against the appropriate sides of their respective grooves thereby to resist leakage from the low-pressure port into the regions of the machine shafts.

Finally, although in the embodiments above-described with reference to the drawings the said resilient members as at 10-13 are housed in grooves as at 14-17 formed in the faces of the end plate means remote from the gears, in alternative embodiments and as shown in dotted detail in FIG. 1 these members as at 10' are instead housed in grooves as at 14' formed in the faces 9 of the casing 2 adjacent those faces 8 of the end plate means 5, 6 remote from the gears.

I claim:

1. A rotary intermeshing gear machine including a casing having a low-pressure port and a high-pressure port, at least two intermeshing rotors housed for rotation in said casing, at least one end plate means associated with said rotors, a pressure-balancing arrangement associated with the end face of said end plate means remote from said rotors and with an adjacent face of said casing, said pressure-balancing arrangement including means defining a plurality of separate grooves provided in one of said faces and sealing means which comprise a plurality of resilient members, each of predetermined length and each disposed in a respective said groove, and which separate one from another a plurality of areas on that one face which are individually subjectable to differing fluid-pressures, lands being formed by the material of said one face which each separate a portion of one said groove from an adjacent portion of another said groove, and recess-defining means being formed in each of said lands, and a single non-extrudable element so located adjacent said resilient members by engagement with said grooves and with said recess-defining means that said reslient members are all in substantially full length engagement with said single element whereby together said element and members establish fluid-sealing between said end face and said adjacent face, and those portions of said element which engage said recess-defining means each forming a bridge crossing from a said portion of one said groove to an adjacent said portion of another said groove.

2. A machine as claimed in claim 1, wherein said grooves and thus said lands are formed in said end face of said end plate means.

3. A machine as claimed in claim 1, wherein a said end plate means is provided on each side of the rotors.

4. A machine as claimed in claim 1, wherein said resilient members are of elastomeric material.

5. A machine as claimed in claim 1, wherein said non-extrudable element is of plastics material.

6. A machine as claimed in claim 1, said machine being so adapted as to be operable either as a pump or as a motor and in either direction of rotation in either case.

7. A machine as claimed in claim 1, wherein said portions of said element are of reduced thickness so that the face of said element adjacent said one face is recessed to provide overlapping relationship of those portions with respect to adjacent sides of the respective said grooves.

8. A machine as claimed in claim 1, wherein said rotors comprise gears housed in overlapping bores formed in said casing.

9. A machine as claimed in claim 8, wherein said gears each have shafts extending from both sides thereof, one of said shafts projecting to the exterior of said casing.

10. A machine as claimed in claim 9, wherein said shafts are rotatably mounted in bushes provided in said casing.

11. A machine as claimed in claim 9, wherein said rotors comprise two gears and wherein an end plate means is provided on each side of said gears, being apertured to receive respective said shafts and being generally of figure-of-eight shape.

12. A machine as claimed in claim 11, wherein four of said grooves are provided in each said end plate means, each said groove housing a respective said resilient member and four of said areas on said end face remote from said rotors being provided, one of said areas being in communication with said low-pressure port, one of said areas being in communication with said high-pressure port and the other two of said areas being in communication with zones of said rotors at high fluid-pressures.

13. A machine as claimed in claim 1, wherein said resilient members and adjacent portions of said non-extrudable element are suitably maintained in said respective grooves in substantially parallel manner.

14. A machine as claimed in claim 13, wherein said adjacent portions are disposed on those sides of their respective resilient members remote from the associated one of said areas subjectable to fluid-pressures.

15. A machine as claimed in claim 14, wherein spacing means are provided on that side of each said resilient member adjacent its associated area subjectable to fluid pressures.

16. A machine as claimed in claim 15, wherein said spacing means are formed integrally with their respective said resilient members and suitably spaced apart therealong.

* * * * *